US007877032B2

(12) United States Patent
Takeuchi

(10) Patent No.: US 7,877,032 B2
(45) Date of Patent: Jan. 25, 2011

(54) IMAGE FORMING APPARATUS

(75) Inventor: Yasushi Takeuchi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 412 days.

(21) Appl. No.: 12/026,970

(22) Filed: Feb. 6, 2008

(65) Prior Publication Data

US 2008/0187352 A1 Aug. 7, 2008

(30) Foreign Application Priority Data

Feb. 7, 2007 (JP) ..... 2007-028595

(51) Int. Cl.
*G03G 15/16* (2006.01)

(52) U.S. Cl. ..... 399/66; 399/101; 399/235; 399/264

(58) Field of Classification Search ..... 399/50, 399/55, 66, 101, 235, 264, 302
See application file for complete search history.

(56) References Cited

U.S. PATENT DOCUMENTS

| | | | | |
|---|---|---|---|---|
| 6,198,491 | B1 | 3/2001 | Honda | |
| 6,473,574 | B1 * | 10/2002 | Usui et al. | 399/66 |
| 7,242,887 | B2 * | 7/2007 | Takeuchi et al. | 399/101 |
| 2005/0276620 | A1 * | 12/2005 | Omata | 399/49 |

FOREIGN PATENT DOCUMENTS

| | | | |
|---|---|---|---|
| JP | 7-295347 | A | 11/1995 |
| JP | 8-297420 | A | 11/1996 |
| JP | 2000-131957 | A | 5/2000 |
| JP | 2000-172027 | A | 6/2000 |
| JP | 2001-5237 | A | 1/2001 |
| JP | 2002-207403 | A | 7/2002 |
| JP | 2002-244512 | A | 8/2002 |

* cited by examiner

*Primary Examiner*—David M Gray
*Assistant Examiner*—Barnabas T Fekete
(74) *Attorney, Agent, or Firm*—Fitzpatrick, Cella, Harper & Scinto

(57) ABSTRACT

An image forming apparatus includes an image bearing member, a toner image forming member, an intermediary transfer member for forming a primary transfer portion, and a primary transfer member supplied with a transfer voltage. The apparatus also has a voltage source for supplying, to the primary transfer member, a transfer voltage and a voltage of a polarity opposite to the transfer voltage, an image bearing member cleaning apparatus for removing toner from the image bearing member, a secondary transferring member, and an intermediary transfer member cleaning apparatus for electrostatically removing toner from the intermediary transfer member. The apparatus further has a voltage source control apparatus for controlling the voltage source so as to apply, to the primary transfer member, a voltage having an absolute value larger than a discharge threshold and having the polarity opposite to the transfer voltage, when a non-recording toner pattern passes through the primary transfer portion.

12 Claims, 6 Drawing Sheets

IMAGE FORMING APPARATUS

FIELD OF THE INVENTION AND RELATED ART

The present invention relates to an image forming apparatus in which a toner image formed on its image bearing member is transferred (primary transfer) onto its intermediary transfer member, is moved through the primary transfer area by the movement of the intermediary transfer member while voltage which is the same in polarity as the normally charged toner is applied to the primary transfer member, and is removed by its cleaning apparatus for cleaning the image bearing member. More specifically, it relates to the control of the voltage which is applied to the primary transfer member while the toner image is moved through the primary transfer area, and which is the same in polarity as the normally charged toner.

The present invention relates to an image forming apparatus in which a toner image formed on its image bearing member is transferred (primary transfer) onto a recording medium borne on its recording medium conveying member, and toner particles remaining the recording medium conveying member is are removed by the image bearing member cleaning apparatus after the toner particles are moved through the transfer area in which voltage which is the same in polarity as the normally charged toner is applied. More specifically, it relates to the control of the voltage which is applied to the primary transfer member while the toner image is moved through the primary transfer area, and which is the same in polarity as the normally charged toner.

There have been put to practical use various image forming apparatuses which form a toner image on their photosensitive drums with the use of charged toner, and transfer the toner image onto a sheet of recording medium borne on their recording medium bearing belts, or their intermediary transfer belts. Some of them are designed to form a toner image which is not transferred onto the recording medium, more specifically, in order to keep the image forming apparatuses stable in image quality (This toner image hereafter may be referred to as "throwaway toner image").

Japanese Laid-open Patent Application 2002-244512 discloses an image forming apparatus which forms a toner image on its photosensitive drum during the intervals between the formation of an image and the formation of the next image. More specifically, in the case of this image forming apparatus, as the cumulative length of time that its developing apparatus is in use reaches a preset value, a throwaway toner image is formed on its photosensitive drum to consume the old toner particles on the development roller, that is, the toner particles which have remained on the developer roller for a long time, so that the peripheral surface of the development roller will be coated with a fresh supply of toner.

A throwaway toner image formed by an image forming apparatus which employs a recording medium conveying member or an intermediary transfer member is not transferred onto a recording medium. That is, it is removed by an apparatus for cleaning the image bearing member, which is disposed in the adjacencies of the image bearing member. Thus, while the recording medium bearing member or intermediary transfer member is conveyed through the transfer area, that is, the area in which a toner image is to be transferred from the image bearing member, voltage which is opposite in polarity to the normal transfer voltage, that is, voltage which is the same in polarity as the normally charged toner, is applied to the recording medium bearing member or intermediary transfer member, in order to ensure that the throwaway toner image remains on the image bearing member while it is moved through the transfer area.

However, even with the recording medium bearing member or intermediary transfer member charged to the same polarity as the normally charged toner, it is impossible to prevent the problem that some of the toner particles making up the throwaway toner image still transfer from the image bearing member onto the recording medium bearing member or intermediary transfer member. This problem occurs for the following reason: A throwaway toner image contains a certain amount of toner particles charged to the opposite polarity from the normal polarity, and these toner particles respond to the voltage which is opposite in polarity to the normal transfer voltage, therefore, electrostatically transferring onto the recording medium bearing member or intermediary transfer member. As for the toner particles in the throwaway toner image, which are insufficient in the amount of electrical charge, they are captured by the recording medium bearing member or intermediary transfer member as they come into contact with the recording medium bearing member or intermediary transfer member.

The toner particles having transferred onto the recording medium bearing member or intermediary transfer member to which the reverse bias was being applied, are removed by the cleaning apparatus disposed in the adjacencies of the recording medium bearing member or intermediary transfer member. As a member for cleaning the recording medium bearing member or intermediary transfer member, the cleaning apparatus employs a cleaning blade (frictional cleaning member), which is simple in structure, yet, highly effective in cleaning performance.

However, a cleaning blade tends to frictionally wear the recording medium bearing member or intermediary transfer belt. Thus, as the means to prevent this problem, a brush to which voltage is applied, has tried, in place of a cleaning blade, to clean the recording medium bearing member or intermediary transfer member. However, the brush failed to satisfactorily remove the throwaway toner image. That is, the toner particles on the recording medium bearing member or intermediary transfer belt, which were insufficient in the amount of electrical charge, fail to be electrostatically removed, remaining therefore on the surface of the recording medium bearing member or intermediary transfer belt.

Using relatively low voltage, for example, a voltage which is 100 in absolute value, as reverse bias voltage, can prevent more or less the transfer of reversely charged toner particles (FIG. 5). However, a cleaning apparatus designed to electrostatically remove toner cannot reduce the amount by which toner particles which are small in the amount of electrical charge remain adhered to the recording medium bearing member or intermediary transfer member.

SUMMARY OF THE INVENTION

Thus, the primary object of the present invention is to provide an image forming apparatus capable of satisfactorily cleaning its recording medium bearing member or intermediary transfer member in a short length of time, with the use of its cleaning member designed to electrostatically remove toner, during an operation in which a throwaway toner image is formed.

According to an aspect of the present invention, there is provided an image forming apparatus comprising an image bearing member bearing a normal toner image and a toner pattern; toner image forming means for forming the normal toner image in an image area of said image bearing member and for forming the toner pattern in a non-image-area of said image bearing member; an intermediary transfer member, contactable to said image bearing member, for forming a primary transfer portion for primary transfer of the toner image from said image bearing member; a primary transfer member for being supplied with a transfer voltage for primary transfer of the toner image from said image bearing member onto said intermediary transfer member; a voltage source for supplying, to said primary transfer member, a transfer voltage and a voltage of a polarity opposite to the transfer voltage; image bearing member cleaning means for removing toner from said image bearing member; secondary transferring means for secondary transfer of the toner image from said intermediary transfer member onto a recording material; intermediary transfer member cleaning means for electrostatically removing toner from said intermediary transfer member; and voltage source control means for controlling said voltage source so as to apply, to said primary transfer member, a voltage having an absolute value larger than a discharge threshold and having the polarity opposite to the transfer voltage, when the toner pattern passes through said primary transfer portion.

According to an aspect of the present invention, there is provided an image forming apparatus comprising an image bearing member bearing a normal toner image and a toner pattern; toner image forming means for forming the normal toner image in an image area of said image bearing member and for forming the toner pattern in a non-image-area of said image bearing member; a recording material carrying member for contacting to said image bearing member to form a transfer portion and for carrying a recording material; a transfer member for being supplied with a transfer voltage for transferring, in said transfer portion, a toner image from said image bearing member onto the recording material carried on said recording material carrying member; a voltage source for applying, to said transfer member, a transfer voltage and a voltage having a polarity opposite to the transfer voltage; image bearing member cleaning means for removing toner from said image bearing member; recording material carrying member cleaning means for electrostatically removing toner from said recording material carrying member; and voltage source control means for controlling said voltage source so as to apply, to said transfer member, a voltage having an absolute value larger than a discharge threshold and having the polarity opposite to the transfer voltage, when the toner pattern passes through said transfer portion.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, a few of the preferred embodiments of the present invention will be described with reference to the appended drawings. The present invention which relates to an image forming apparatus, which is provided with an intermediary transfer member or a recording medium bearing member, and is capable of forming a throwaway toner, that is, a toner image not to be transferred onto recording medium, is applicable to any image forming apparatus, as long as the image forming apparatus, parts (a part), or the entirety of the structure of which are the same as, or similar to, those of the image forming apparatuses in the following embodiments of the present invention. Not only is the present invention is usable to adjust the amount by which electrical charge is given to toner, but also, is usable to adjust the extent to which an image bearing member is polished (frictionally worn) with the use of toner (Patent Document 1). Further, not only is the present invention is applicable to an image forming apparatus which reversely develops a latent image, but also, is applicable to an image forming apparatus which normally develops a latent image. Moreover, not only is the present invention applicable to an image forming apparatus which uses negatively chargeable toner, but also, is applicable to an image forming apparatus which uses positively chargeable toner.

Not only is the present invention applicable to a full-color image forming apparatus of the so-called tandem type, but also, is applicable to an image forming apparatus made up of a single image bearing member and multiple developing apparatuses disposed in the adjacencies of the single image bearing member, and an image forming apparatus having no more than three image bearing members disposed in the adjacencies of the peripheral surface of its intermediary transfer member or recording medium bearing member.

In the following description of this embodiment, only the essential portions of the image forming apparatus, which are related to the formation and transfer of a toner image, will be described. However, the present invention is applicable to various forms of a image forming apparatuses, such as a printer, a copying machine, a facsimile machine, a multifunction image forming apparatus, etc., which are made up of the above-mentioned essential portions, and other devices, equipment, housing, etc., which are necessary for producing documents, pictures, etc.

The widely known items, such as the structural components, electric power sources, and materials, of the image forming apparatuses disclosed in Patent Documents 1 and 2, and the recording medium conveying belt 38 for the image forming process of the apparatuses, will not be illustrated to prevent the repetition of the same descriptions.

Embodiment 1

Figure 1:
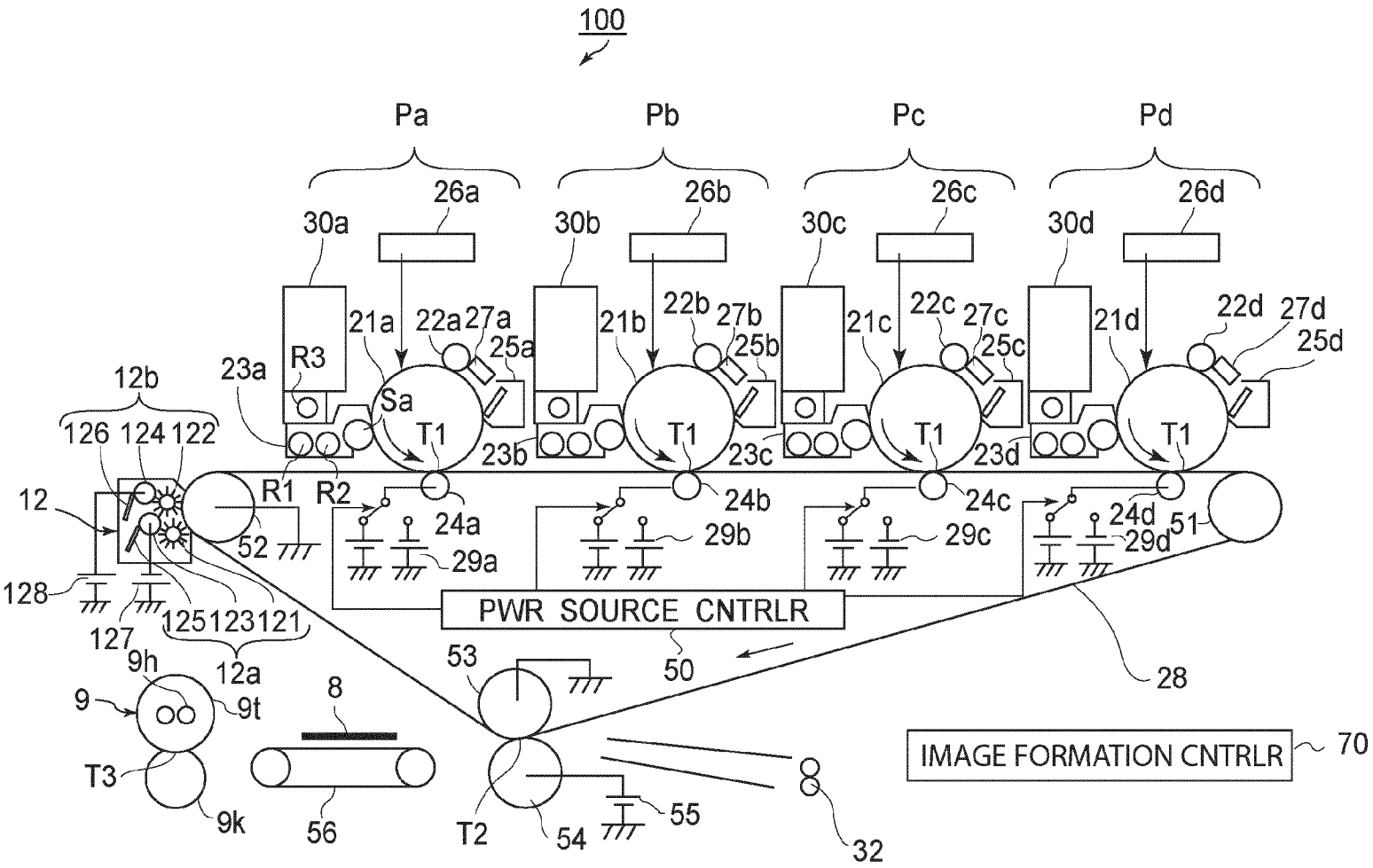
FIG. 1 is a schematic sectional view of the image forming apparatus in the first embodiment of the present invention, showing the structure of the apparatus.
Figure 2:
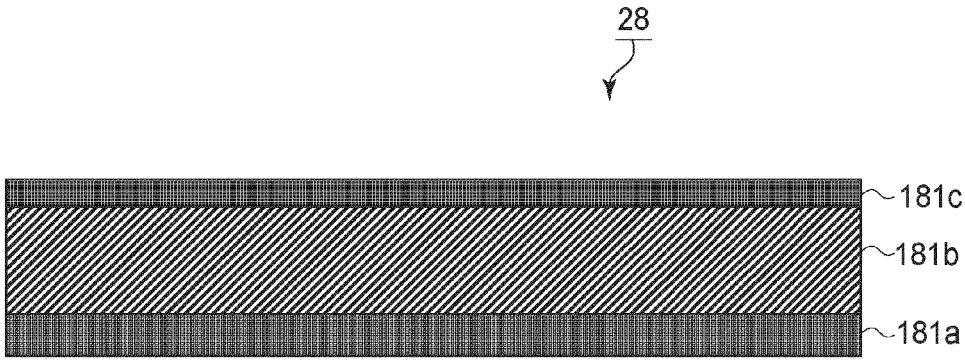
FIG. 2 is a schematic sectional view of the intermediary transfer belt, showing the structure of the belt.

FIG. 1 is a schematic sectional view of the image forming apparatus in the first embodiment of the present invention, and shows the structure of the apparatus. FIG. 2 is a schematic sectional view of the intermediary transfer belt, and shows the structure of the belt. The image forming apparatus 100 in the first embodiment is a full-color image forming apparatus of the so-called tandem type, which has yellow, magenta, cyan, and black image forming portions Pa, Pb, Pc, and Pd (toner image forming means), which are juxtaposed in the adjacencies of the outward side of the top portion of the loop which the intermediary transfer belt 28 forms.

Referring to FIG. 1, the intermediary transfer belt 28, which is an example of an intermediary transfer member, is stretched around a driver roller 51, a follower roller 52, and a secondary transfer roller 53, being thereby suspended by the three rollers. The driver roller 51 is rotationally driven by an unshown motor (for example, stepping motor). As the driver roller 51 is rotationally driven, it circularly moves the intermediary transfer belt 28 in the rightward direction of the drawing. The intermediary transfer belt 28 is an elastic belt.

Referring to FIG. 2, the intermediary transfer belt 28 is made up of three layers, that is, a resin layer 181*a*, an elastic layer 181*b*, and a surface layer 181*c*. As examples of the material for the resin layer 181*a*, one or more substances chosen from the following list may be used: polycarbonate, fluorinated resin (ETFE, PVDF), polystyrene, chloro-polystyrene, poly-α-methyl-styrene, styrene-butadiene copolymer, styrene-vinyl-chloride copolymer, styrene-vinyl acetate copolymer, styrene-maleic acid copolymer, styrene-acrylic ester copolymer (styrene-methyl acrylate copolymer, styrene-ethyl acrylate copolymer, styrene-butyl acrylate copolymer, styrene-octyl acrylate copolymer, and styrene-phenyl acrylate copolymer, etc.), styrene-methacrylate ester copolymer (styrene-methyl methacrylate copolymer, styrene-ethyl methacrylate copolymer, styrene-phenyl methacrylate copolymer, etc.), styrene-α-methyl chloacrylate copolymer, styrenated resin (monomeric or copolymer which contains styrene or styrene-substitution product) such as styrene-acrylonitrile-acrylate ester copolymer, methacrylate methyl resin, butyl methacrylate resin, ethyl methacrylate resin, butyl acrylate resin, denatured acrylic resin (silicon-denatured acrylic resin, vinyl chloride-denatured acrylic resin, acrylic urethane resin, etc.), vinyl chloride resin, styrene-vinyl acetate copolymer, vinyl chloride-vinyl acetate copolymer, rosin-denatured maleic acid resin, phenol resin, epoxy resin, polyester resin, polyester-polyurethane resin, polyethylene, polypropylene, polybutadiene, polyvinylidene chloride, ionomer resin, polyurethane resin, silicone resin, ketone resin, ethylene-ethyl acrylate copolymer, xylene resin, polyvinyl-butyral resin, polyamide resin, polyimide resin, denatured polyphenylene oxide resin, denatured polycarbonate, etc. However, the choices do not need to be limited to those in the list given above.

As the elastic material (elastic rubber, elastomer) for the above-mentioned elastic layer 181*b*, one or more substances chosen from the following list may be used: butyl rubber, fluorinated rubber, acrylic rubber, EPDM, NBR, acrylonitrile-butadiene-styrene rubber, natural rubber, isopropylene rubber, styrene-butadiene rubber, butadiene rubber, ethylene-propylene rubber, ethylene-propylene-terpolymer, chloroprene rubber, chlorosulfonated polyethylene, chlorinated polyethylene, urethane rubber, syndiotactic 1,2-polybutadiene, epichlorohydrin rubber, silicone rubber, fluorinated rubber, polysulfide rubber, polynorbornene rubber, hydrogenated nitrile rubber, thermoplastic elastomer (for example, polystrene polyolefin, polyvinylchloride, polyurethane, polyamide, polyurea, polyester, and fluorinated resins), etc. Needless to say, however, the choices do not need to be limited to those listed above.

Although there is no strict requirement regarding the material for the surface layer 181*c*, the material for the surface layer 181*c* is desired to be a substance capable of reducing as much as possible the adhesive force between the surface of the intermediary transfer belt 28 and a toner image so that the toner can be efficiently transferred (secondary transfer) away from the intermediary transfer belt 28. As the examples of the material for the surface layer 181*c*, one substance among polyurethane, polyester, epoxy resin, and the like, or two or more substances among elastic substances (elastic rubber, elastomer), such as butyl rubber, fluorinated rubber, acrylic rubber, EPDM, NBR, acrylonitrile-butadiene-styrene rubber, natural rubber, isopropylene rubber, styrene-butadiene rubber, butadiene rubber, ethylene-propylene rubber, ethylene-propylene-polymer, chloroprene rubber, chlorosulfonated polyethylene, chlorinated polyethylene, and urethane rubber, may be used. Further, the above-mentioned substances may be used with one or more among such a substance as fluorinated resin, fluorinated compound, fluorinated carbon, titanium dioxide, silicon carbide, etc., which reduce the above-mentioned substances in surface energy, and therefore, can provide the surface layer with a greater amount of lubricity. These substances which can provide the surface layer 181*c* with a greater amount of lubricity may be used in powdery or particular form. When they are used in particular form (dispersed), they may be uniform or non uniform in particle diameter. Incidentally, the choices of the material for the surface layer 181*c* do not need to be limited to those listed above.

In consideration of the transfer efficiency, the volume resistivity ρ of the intermediary transfer belt 28 is desired to be in a range of $10^5$-$10^{15}$ Ωcm. Thus, an electrical resistance adjustment agent is added to the materials for the resin layer 181*a* and elastic layer 181*b*. There is no restriction regarding the choice of the electrical resistance adjustment agent. Examples of the electrical resistance adjustment agent are carbon black, graphite, powder of a metallic substance (such as aluminum or nickel), and electrically conductive metallic oxides, such as, tin oxide, titanium oxide, antimony oxide, indium oxide, potassium titanate, compound of antimony oxide and tin oxide (ATO), compound of indium oxide and tin oxide (ITO), etc. Instead of electrically conductive metallic oxides, microscopic particles of dielectric substance, such as barium sulphate, magnesium silicate, calcium carbonate, etc., which are coated with one of the above-mentioned electrically conductive metallic substances, may be used. The choices of the electrical resistance adjustment agent do not need to be limited to the above listed ones.

In the first embodiment, the thickness of the resin layer 181*a* is 100 μm, and the thickness of the elastic layer 181*b* is 200 μm. The thickness of the surface layer 181*c* is 5 μm. The volume resistivity ρ of the intermediary transfer belt 28 is $10^9$ Ωcm (which was measured with probe, which meets JIS-K6911, while applying 100 V for 60 seconds, at 23° C. and 50% RH).

Referring to FIG. 1, the image forming portions Pa, Pb, Pc, and Pd are juxtaposed in the adjacencies of the intermediary transfer belt 28. More specifically, they are disposed next to the outward surface of the intermediary transfer belt 28, which corresponds to the top portion (straight portion) of the loop which the belt 28 forms. Further, in terms of the moving direction of the intermediary transfer belt 28, they are between the upstream and downstream ends of the loop of the intermediary transfer belt 28. The area of contact between each of the photosensitive drums 21*a*, 21*b*, 21*c*, and 21*d* and the intermediary transfer belt 28 is the transfer portion T1. The image forming portions Pa, Pb, Pc, and Pd are the same in structure, although they are different in the color (yellow, magenta, cyan, or black) of the toner they use in their developing apparatuses 23*a*, 23, 23*c*, and 23*d*, respectively. Thus, only the image forming apparatus Pa will be described in detail, and it is assumed that the structure of the image forming portions Pb, Pc, and Pd can be easily understood by replacing the referential letter "a" assigned to the image forming portion for forming a yellow toner image, with "b, c, or d".

The image forming portion Pa has the photosensitive drum 21*a*, which is an example of an image bearing member and rotates at the same peripheral velocity as the intermediary transfer belt 28. It also has a charging apparatus 22*a*, an exposing apparatus 26*a*, a developing apparatus 23*a*, a transfer roller 24*a*, and a cleaning apparatus 25*a*, which are arranged in the adjacencies of the peripheral surface of the photosensitive drum 21*a*. These apparatuses are controlled by an image formation controlling device 70 (means for operating image forming apparatus in selected mode). The operation for forming a normal image, and the developer (toner) expulsion control sequence, which will be described next, are controlled by the controlling device 70.

The charging apparatus 22*a*, which is an example of a charging means, uniformly charges the peripheral surface of the photosensitive drum 21*a* to a preset potential level before the formation of an electrostatic latent image.

The exposing apparatus 26*a*, which is an example of an exposing means, forms an electrostatic latent image which corresponds to the yellow color component of an original, by scanning the peripheral surface of the photosensitive drum 21*a* with a beam of laser light which it emits while pulse modulating the beam with pictorial signals which correspond to the yellow color component of the original.

The developing apparatus 23*a*, which is an example of a developing means, mixes the toner supplied from a toner bottle 30*a*, which is an example of a developer delivering means, with magnetic carrier, and charges the toner by stirring the toner with a supply roller R1 and a development roller R2 while it supplies the development sleeve Sa with the toner by conveying the toner with the supply roller R1 and development roller R2. The charged toner is conveyed, along with the magnetic carrier, to the development sleeve Sa, and is coated in a thin layer on the peripheral surface of the development sleeve Sa. Then, the thin layer of toner on the peripheral surface of the development sleeve Sa is conveyed by the rotation of the development sleeve Sa, to the area of contact between the peripheral surface of the photosensitive drum 21*a* and the peripheral surface of the development sleeve Sa. In the area of contact, development voltage, which is a combination of DC voltage and AC voltage, is applied to the development sleeve Sa. As a result, the toner on the development sleeve Sa electrostatically transfers onto the peripheral surface of the photosensitive drum 21*a*, and electrostatically adheres to the electrostatic latent image on the peripheral surface of the photosensitive drum 21*a*, developing thereby the electrostatic latent image into an image formed of toner (which hereafter will be referred to simply as toner image).

The transfer roller 24*a*, which is an example of a transferring means, is always kept pressed against the photosensitive drum 21*a* with the presence of the intermediary transfer belt 28 between the transfer roller 24*a* and peripheral surface 21*a*, forming thereby a transfer area T1, which is an example of a transferring portion, between the photosensitive drum 21*a* and intermediary transfer belt 28.

A transfer power source 29*a*, which is an example of an electric power source, is controlled by an electric power source controlling device 50 (electric power source controlling means). It electrostatically moves the toner image from the photosensitive drum 21*a* onto the intermediary transfer belt 28 by outputting voltage, the polarity of which is opposite to the normal polarity to which toner is charged, to the transfer roller 24*a*. However, when the image forming apparatus 100 is forming a throwaway toner image, which is not to be transferred onto recording medium, the transfer power source 29*a* outputs voltage, the polarity of which is the same as the normal polarity to which toner is charged, to the transfer roller 24*a*, allowing thereby the throwaway toner image to move straight through the transfer area T1.

In the first embodiment, toner is negatively charged; a reversal development method is employed. More specifically, the charging apparatus 22*a* negatively charges the peripheral surface of the photosensitive drum 21*a* to −500 V, for example. Thus, as numerous points of the charged peripheral surface of the photosensitive drum 21*a* are exposed by the exposing apparatus 26*a*, their potential level falls to −150 V. The development voltage applied to the development sleeve Sa is 350 V. Thus, the negatively charged toner adheres to the numerous points of the peripheral surface of the photosensitive drum 21*a*, which have been reduced in potential level as described above. Then, the transfer power source 29*a* transfers the negatively charged toner particles in the toner image on the photosensitive drum 21*a*, onto the intermediary transfer belt 28 by outputting +1,000 V to the transfer roller 24*a*.

The cleaning apparatus 25*a*, which is an example of a cleaning means for cleaning an image bearing member, removes the transfer residual toner, that is, the toner which moved through the transfer area T1, in other words, the toner which was not transferred onto the intermediary transfer belt 28, by scraping the peripheral surface of the photosensitive drum 21*a* with its cleaning blade.

First, a yellow toner image (normal toner image) is formed on the portion of the peripheral surface of the photosensitive drum 21*a*, which is in the image forming area. Then, it is transferred onto the intermediary transfer belt 28 in the transfer area T1. Then, the yellow toner image on the intermediary transfer belt 28 is moved into the transfer area T1, which corresponds to the photosensitive drum 21*b*. By the time the yellow toner image on the intermediary transfer belt 28 reaches the transfer area T1 for the image forming portion Pb, a magenta toner image (normal toner image) will have been formed on the portion of the peripheral surface of the photosensitive drum 21*b* in the image forming area of the image forming portion Pb, through the same steps as those through which the yellow toner image was formed. This magenta toner image is transferred in layers onto the yellow toner image on the intermediary transfer belt 28, in the transfer area T1 for the image forming portion Pb.

Similarly, a cyan toner image (normal toner image) is formed on the photosensitive drum 21*c*. Then, this cyan toner image is transferred in layers onto the yellow and magenta toner images on the intermediary transfer belt 28, in the transfer area T1, which corresponds to the photosensitive drum 21*c*. Lastly, a black toner image (normal toner image) formed on the photosensitive drum 21*d* is transferred in layers onto the yellow, magenta, cyan toner images on the intermediary transfer belt 28, in the transfer area T1, which corresponds to the photosensitive drum 21*d*. The four monochromatic toner images, which are different in color, and were transferred onto the intermediary transfer belt 28 in the image forming portions Pa, Pb, Pc, and Pd, respectively, are conveyed by the movement of the intermediary transfer belt 28 into the secondary transfer area T2, in which they are transferred together (secondary transfer) onto a recording medium 8. Incidentally, regarding the recording medium 8, the image forming apparatus 100 is fitted with an unshown sheet feeder cassette, in which a substantial number of recording mediums 8 are stored. The recording mediums 8 are fed one by one from the sheet feeder cassette into the main assembly of the image forming apparatus 100. Each recording medium 8 is kept on standby by a pair registration rollers 32, and then, is released by the registration rollers 32 with such timing that the recording medium 8 arrives at the secondary transfer area T2 at the same time as the four monochromatic toner images, different in color, on the intermediary transfer belt 28 arrive at the secondary transfer area T2.

A secondary transfer roller 54 is a rubber roller made up of an electrically conductive spongy substance. It is disposed on the outward side of the loop which the intermediary transfer belt 28 forms. It is kept pressed against the aforementioned secondary transfer roller 53, which is disposed on the inward side of the belt loop, with the presence of the intermediary transfer belt 28 between the two rollers 54 and 53, forming thereby the secondary transfer area T2 between the intermediary transfer belt 28 and secondary transfer roller 54. The secondary transfer roller 53 is grounded. To the secondary transfer roller 54, transfer voltage is applied from a transfer voltage power source 55. Thus, an electric field which electrostatically transfers the four monochromatic color toner images on the intermediary transfer belt 28, which is an example of an intermediary transferring means, onto the recording medium 8, is formed. In the first embodiment, the transfer power source 55 outputs a transfer voltage, which is in the range of +1,000 V-+2,000 V, to the secondary transfer roller 54, in order to transfer (secondary transfer) the negatively charged toner particles in the four monochromatic color toner images, onto the recording medium 8.

When the image forming apparatus 100 is in the mode for continuous image formation, the secondary transfer roller 54 is kept in contact with the intermediary transfer belt 28 even while a portion of the intermediary transfer belt 28, which is not currently involved in secondary transfer, moves through the secondary transfer area T2. However, while the portion of the intermediary transfer belt 28, which is not currently involved in secondary transfer, moves through the secondary transfer area T2, the transfer voltage is kept lower at roughly +100 V.

After the transfer of the four monochromatic color toner images onto the recording medium 8, the recording medium 8 is separated from the intermediary transfer belt 28, and is conveyed to a fixing apparatus 9 by a conveyer belt 56. In the fixing apparatus 9, the recording medium 8 is conveyed through a fixation nip T3, which a fixation roller 9*t* heated by a heater 9*h*, and a pressure roller 9*k*, form to apply heat and pressure to the four monochromatic color toner images. As a result, the toner images are fixed to the surface of the recording medium 8.

<Cleaning Apparatus>

The transfer residual toner, that is, a certain amount of toner which was in the toner images on the intermediary transfer belt 28, but, did not transfer onto the recording medium 8, in other words, the toner on the recording medium 8, which moved past the secondary transfer area T2, is conveyed to the cleaning apparatus 12 (means for cleaning intermediary transferring means) by the movement of the intermediary transfer belt 28, and is removed from the intermediary transfer belt 28, which is an example of the intermediary transferring means. The cleaning apparatus 12, which is an example of the means for cleaning the intermediary transferring means, employs an electrostatic fur brush, that is, an electrically conductive fur brush.

The cleaning apparatus 12, which is disposed next to the intermediary transfer belt 28, is provided with a pair of electrically conductive fur brushes 121 and 122, which are positioned in the housing of the cleaning apparatus 12. The fur brushes 121 and 122 are in contact with the intermediary transfer belt 28. On the opposite side of the fur brushes 121 and 122 from the intermediary transfer belt 28, a pair of metallic rollers 123 and 124, which are formed of aluminum, are disposed in contact with the electrically conductive fur brushes 121 and 122, respectively. The metallic rollers 121 and 122 are provided with a surface layer of anodic oxide of aluminum. On the opposite side of each of the metallic rollers 123 and 124 from the electrically conductive fur brushes 121 and 122, a pair of cleaning blades 125 and 125 are disposed in contact with the metallic rollers 123 and 124, respectively.

The electrically conductive fur brush 121, metallic roller 123, and cleaning blade 125 make up the upstream cleaning portion 12*a*, whereas the electrically conductive fur brush 122, metallic roller 124, and cleaning blade 126 make up the downstream cleaning portion 12*b*. The upstream and downstream cleaning portions 12*a* and 12*b* are juxtaposed in parallel to the intermediary transfer belt 28.

The electrically conductive fur brushes 121 and 122 are made up of a metallic roller, and multiple strands of Nylon fibers planted on the peripheral surface of the metallic roller at a ratio of 50,000 strand/inch$^2$. The Nylon fiber is 10 MΩ in electrical resistance, and 6 denier in thickness. It is made of Nylon in which carbon particles have been dispersed. The electrically conductive fur brushes 121 and 122 are positioned so that the amount of their apparatus intrusion into the intermediary transfer belt 28 is roughly 10 mm. They are driven by an unshown motor in the counter direction to the moving direction of the intermediary transfer belt 28, at roughly ¼ of the peripheral velocity of the intermediary transfer belt 28 (at relative velocity of 125%).

The metallic rollers 123 and 124 are disposed so that the amount of their apparent intrusion into the electrically conductive fur brushes 121 and 122, respectively, is roughly 1.0 mm. They are rotationally driven at the same peripheral velocity as the electrically conductive fur brushes 121 and 122, in such a direction that their peripheral surfaces move in the same direction as the moving direction of the peripheral surfaces of the fur brushes 121 and 122. The cleaning blades 125 and 126, which are placed in contact with the metallic roller 123 and 124, respectively, are made up of urethane rubber, and are positioned so that the amount of their apparent intrusion into the metallic rollers 123 and 124, respectively, is 1.0 mm.

To the upstream and downstream cleaning portions 12*a* and 12*b*, −500 V of DC voltage (relative to ground) is applied by a DC power source 127. Thus, an electric field, which works in the direction to induce the positively charged toner particles in the above described transfer residual toner on the intermediary transfer belt 28, to transfer onto the electrically conductive fur brush 121, is formed between the follower roller 52, which is grounded, and the electrically conductive fur brush 121. Then, as the electrically conductive fur brush 121 rotates, the positively charged toner particles having electrostatically transferred onto the electrically conductive fur brush 121 come into contact with the metallic roller 123, and electrostatically transfers onto the metallic roller 123. Then, as the metallic roller 123 rotates, the positively charged toner particles having adhered to the metallic roller 123 are scraped away from the metallic roller 123 by the cleaning blade 125.

The negatively charged toner particles in the transfer residual toner on the intermediary transfer belt 28 move through the upstream cleaning portion 12*a*, and reach the electrically conductive fur brush 122 of the downstream cleaning portion 12*b*.

To the metallic roller 124 of the downstream cleaning portion 12*b*, +500 V of DC voltage (relative to ground) is applied by a DC power source 128. Thus, an electric field, which works in the direction to induce the negatively charged toner particles on the intermediary transfer belt 28 to transfer onto the electrically conductive fur brush 122, is formed between the grounded follower roller 52 and the electrically conductive fur brush 122. Then, as the electrically conductive fur brush 122 rotates, the negatively charged toner particles having electrostatically transferred onto the electrically conductive fur brush 122 come into contact with the metallic roller 124, and electrostatically transfer onto the metallic roller 124. Then, as the metallic roller 124 rotates, the negatively charged toner particles having adhered to the metallic roller 124 are scraped away from the metallic roller 124 by the cleaning blade 126. This is how the toner in the toner images on the intermediary transfer belt 28, which moved through the secondary transfer area T2, that is, the toner remaining on the intermediary transfer belt 28, on the downstream side of the secondary transfer area T2, can be removed.

Compared to a conventional cleaning apparatus which uses only a cleaning blade (frictional blade), the cleaning apparatus 12 in this embodiment, which electrostatically removes toner with the use of the charged electrically conductive fur brushes, is smaller in the amount of the load to which the intermediary transfer belt 28 is subjected, and also, is smaller in the amount of the vibrations attributable to the change in the load. It is also advantageous in that the intermediary transfer belt 28 suffers from virtually no frictional wear.

Further, in this embodiment, in order to improve the image forming apparatus in image quality, and to enable the image forming apparatus to accommodate various recording media, which are different in material, size, etc., an elastic belt is employed as the intermediary transfer belt 28 of the image forming apparatus. Normally, the surface of an elastic belt is no less than 1 μm in roughness (ten point average roughness). If the intermediary transfer belt 28 exceeds 1 μm in surface roughness, it is difficult for a cleaning blade to thoroughly remove the transfer residual toner. From this standpoint, a cleaning apparatus which electrostatically removes toner with the use of a charged electrically conductive fur brush is advantageous over a cleaning apparatus employing a cleaning blade, in that even if the intermediary transfer belt 28 is no less than 1 μm in surface roughness, the former can highly efficiently remove charged toner.

Thus, the image forming apparatus 100 in this embodiment employs the cleaning apparatus 12, which electrostatically removes the transfer residual toner with the use of the electrically conductive fur brushes, instead of a cleaning blade.

However, a cleaning apparatus which electrostatically removes toner is limited in terms of the amount of the toner it can remove. In other words, it cannot deal with as large an amount of toner as that which a cleaning blade can scrape away. Thus, in order to remove a solid image transferred onto the intermediary transfer belt 28 by the cleaning apparatus 12, the intermediary transfer belt 28 needs to be idly rotated several times just for cleaning the belt 28. In other words, the cleaning apparatus 12 is incapable of completely cleaning the intermediary transfer belt 28 on which four toner images, different color, were layered, while the intermediary transfer belt 28 is rotated once. Therefore, if the image forming apparatus 100 is jammed by the recording medium 8, the intermediary transfer belt 28 must be idly rotated several times to remove the toner images remaining on the intermediary transfer belt 28, that is, to clean the intermediary transfer belt 28.

Thus, when a throwaway toner image, that is, the toner image which is not to be transferred onto the recording medium 8, is formed on the photosensitive drums 21*a*, 21*b*, 21*c*, and 21*d*, reverse bias is applied to the transfer rollers 24*a*, 24*b*, 24*c*, and 24*d* as described above. With the application of reverse bias, the throwaway toner image images are prevented from being transferred onto the intermediary transfer belt 28, and therefore, the cleaning apparatus 12 is prevented from being overloaded.

However, there are toner particles which transfer from the photosensitive drums 21*a*, 21*b*, 21*c*, and 21*d* onto the intermediary transfer belt 28, and adhere to the intermediary transfer belt 28, regardless of the presence of the reverse bias. The amount of electrical charge which these toner particles have is very small. Therefore, these toner particles are difficult to electrostatically remove. Thus, with the presence of these toner particles on the intermediary transfer belt 28, it is difficult to thoroughly clean the intermediary transfer belt with the use of the cleaning apparatus 12.

Thus, in this embodiment, in order to increase the efficiency with which the intermediary transfer belt 28 can be cleaned with the cleaning apparatus 12, the reverse bias is controlled in magnitude to increase, in the amount of electrical charge, the toner particles which adhere to the intermediary transfer belt 28 because they are small in the amount of electrical charge.

<Developer (Toner) Expulsion Control Sequence>

Figure 3:
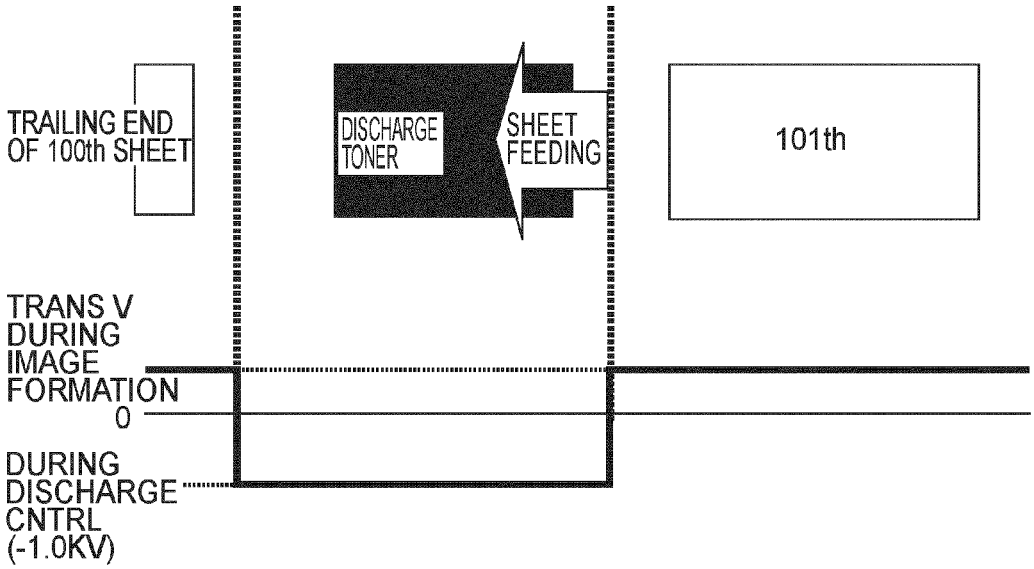
FIG. 3 is a timing chart of the developer (toner) expulsion control sequence.

FIG. 3 is a timing chart of the developer (toner) expulsion control sequence. Referring to FIG. 3 as well as FIG. 1, in this embodiment, in order to keep the image forming apparatus 100 stable in image quality by controlling the toner in the developing apparatuses 23*a*, 23*b*, 23*c*, and 23*d*, in terms of the state of its electrical charge, the image forming apparatus is carrying out the developer (toner) expulsion sequence. More specifically, in order to prevent developer deteriorating in the developing apparatuses 23*a*, 23*b*, 23*c*, and 23*d*, the developers in the developing apparatuses 23*a*, 23*b*, 23*c*, and 23*d* are transferred onto the photosensitive drums 21*a*, 21*b*, 21*c*, and 21*d* by forming a throwaway toner image (toner image of specific pattern). Then, the developing apparatuses 23*a*, 23*b*, 23*c*, and 23*d* are replenished with the unused toner from toner bottles 30*a*, 30*b*, 30*c*, and 30*d*, respectively, by the amount equivalent to the amount of the toner expelled from (transferred out of) the developing apparatuses 23*a*, 23*b*, 23*c*, and 23*d*. As a result, the developing apparatuses 23*a*, 23*b*, 23*c*, and 23*d* are adjusted in the state of toner, in terms of electrical charge.

As the developer (toner) expulsion sequence is started, the image forming operation in which images have been formed with preset (normal) intervals is temporarily put on standby, and a throwaway toner image is formed on the photosensitive drums 21*a*, 21*b*, 21*c*, and 21*d*, with such timing that the formation of the throwaway image falls in the interval (paper interval) between the formation of a normal image, and the formation of the next normal image.

In the developer (toner) expulsion control sequence, a throwaway toner image, which is not to be transferred onto the recording medium 8, is formed on each of the photosensitive drums (image bearing members) 21*a*, 21*b*, 21*c*, and 21*d*, through the same image formation steps as the normal image formation steps, which includes the exposing step. Then, the throwaway toner images are removed by the cleaning apparatus 25*a*, 25*b*, 25*c*, and 25*d* by moving the throwaway toner images through the transfer area T1. For the purpose of minimizing the length of time necessary for the developer (toner) expulsion control sequence, that is, for the purpose of restarting the normal image forming operation as soon as possible, a solid toner image, which is uniform in density, is formed on each of the photosensitive drums 21*a*, 21*b*, 21*c*, and 21*d*, with the same time as the timing with which the normal images are formed to be layered on the intermediary transfer belt 28.

Incidentally, a throwaway toner image can be formed without involving the exposing step. That is, a throwaway toner image can be formed simply by controlling the potential level to which a photosensitive drum is charged, and development bias. However, the method in this embodiment is preferable in that the method in this embodiment is smaller in the amount of adjustments which must be made to form a throwaway toner image, and also, in that this method in this embodiment makes it possible to precisely control the amount by which developer is expelled from (transferred out of) a developing apparatus, by controlling the exposure condition.

Further, when the image forming apparatus 100 is in the normal image formation mode, voltage which is substantially greater in absolute value than the discharge threshold voltage, is applied to the transfer roller 24*a* in order to improve the image forming apparatus 100 in toner image transfer efficiency. Thus, the number of toner particles on the intermediary transfer belt 28, which are insufficient in the amount of charge, is smaller. Thus, there is no problem regarding the cleaning of the intermediary transfer belt 28 with the use of the cleaning apparatus 12 during a normal image forming operation.

Next, the toner expulsion sequence will be described. In this (first embodiment), the amount by which each of color toners was consumed per image was accumulated. Then, as the difference between the cumulative amount of the consumption of each color toner and a preset referential amount of toner consumption reaches a preset value, the toner expulsion control sequence is carried out for a length of time equivalent to the difference. Further, if the difference between the cumulative amount of consumption of one of the toners and the preset referential amount set for this toner reaches a preset value, the toner expulsion control sequence is carried out for the other three toners at the same time, for a length of time long enough to cancel the difference which occurred to the three other toners.

More concretely, the number of picture elements of each image is counted. Then, the picture element count of this image and the picture element count of a referential image, the picture element count of which is smaller than a preset value, is accumulated. Then, as the cumulative value of the difference reaches a preset value, toner is expelled from (transferred out of) the developing apparatus by the amount equivalent to the cumulative value of the difference.

For example, it is assumed that a solid image of size A4 (297 mm in length and 210 mm in width) is 100% in picture element count. If an image which is no more than 5% in picture element count comes in, the difference in picture element count between this image and the image which is 5% in picture element count is accumulated. Then, as the cumulative value of the difference reaches 100%, the formation of the next normal image is put on standby, and the toner expulsion control sequence is carried out during the paper interval, as if the paper interval were extended. That is, when multiple A4 size sheets of recording medium are continuously fed into the image forming apparatus 100 to print multiple copies of an original, which is 4% in picture element count, each copy is short of pictorial information by 1%. Therefore, the cumulative value of the difference reaches 100% as the $100^{th}$ sheet of recording medium is conveyed through the image forming apparatus 100.

Therefore, as will be evident from FIG. 3 as well as FIG. 1, a throwaway toner image is formed on the photosensitive drums 21*a*, 21*b*, 21*c*, and 21*d* to expel toner from the developing apparatuses 23*a*, 23*b*, 23*c*, and 23*d* onto the photosensitive drums 21*a*, 21*b*, 21*c*, and 21*d*, respectively, by the amount equivalent to the amount of the toner necessary to form a solid image of size A4. Thus, only the time necessary to form a throwaway toner image, which is equivalent to the length of a paper of size A4, is the downtime. In other words, the productivity of the image forming apparatus 100 is not seriously affected by the toner expulsion control sequence (mode).

In the toner expulsion control sequence, transfer prevention voltage (reverse bias voltage), which is opposite in polarity to the transfer voltage applied when in the normal image formation mode, is applied to the transfer rollers 24*a*, 24*b*, 24*c*, and 24*d*, in the transfer areas T1. Therefore, at least the toner particles having been charged to the normal polarity (negative polarity) reach the cleaning apparatuses 25*a*, 25*b*, 25*c*, and 25*d*, without being transferred onto the intermediary transfer belt 28, and removed by the cleaning apparatuses 25. The transfer prevention voltage (reverse bias voltage), which is opposite in polarity and is to be used in the toner expulsion control sequence, is set to 1 kV, which is 200 V higher than the discharge start voltage, or 800 V. Therefore, during the toner expulsion control sequence, the toner particles, which are insufficient in the amount of charge, and therefore, would have been transferred are positively charged, and are efficiently removed by the cleaning apparatus 12.

On the other hand, if the reverse bias voltage is excessively low compared to the discharge start voltage, or −800 V, most of the toner particles which are transferred onto the intermediary transfer belt 28 are close to zero in the amount of charge. Therefore, even when the amount of the toner remaining adhered to the intermediary transfer belt 28 is less than the amount of the secondary transfer residual toner in a normal image forming operation, it is difficult to clean the intermediary transfer belt 28 with the use of the cleaning apparatus 12, when the cleaning apparatus 12 is operated under the optimal condition for the removal of the secondary transfer residual toner which occur in a normal image forming operation.

Further, if the reverse bias voltage is substantially higher than a range between the discharge start voltage (−800 V)--2,000 V, the toner particles having been transferred onto the intermediary transfer belt 28 are excessively charged to the positive polarity, being thereby firmly adhered to the surface of the intermediary transfer belt 28. Therefore, it is difficult to electrostatically separate them from the intermediary transfer belt 28, and therefore, it is difficult to clean the intermediary transfer belt 28 with the cleaning apparatus 12.

Figure 4:
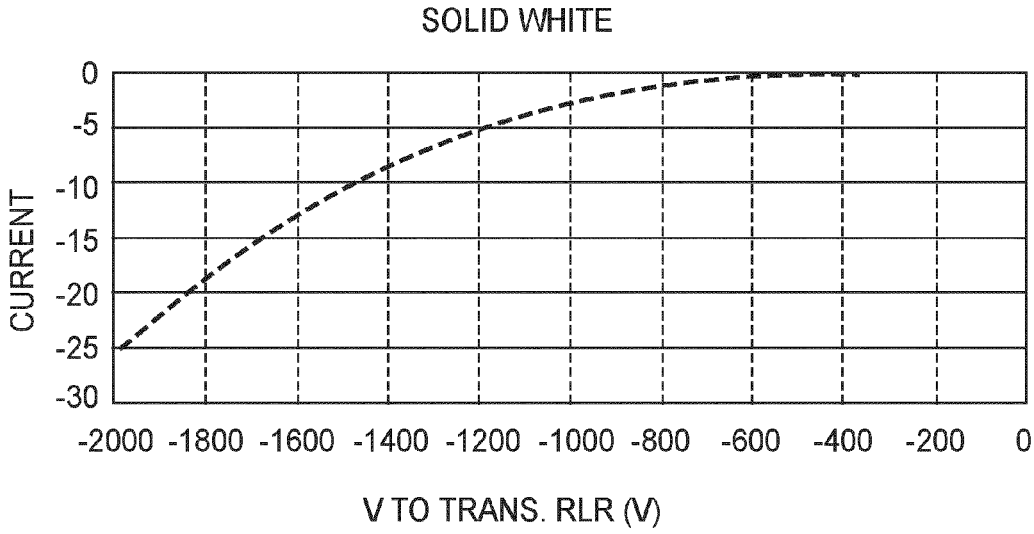
FIG. 4 is a graph which shows the relationship between the voltage applied to the transfer roller, and the current flowed by the voltage.
Figure 5:
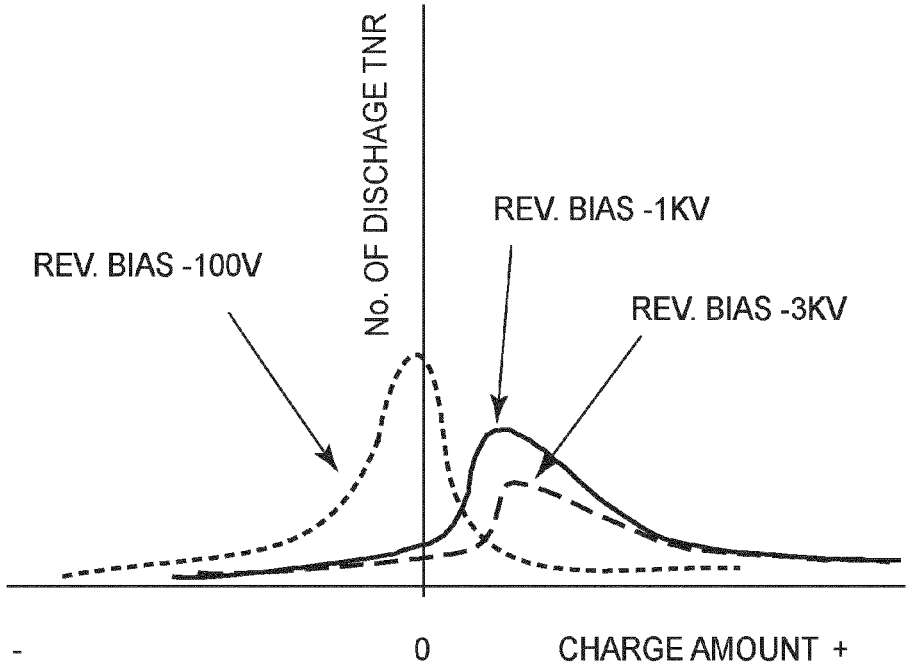
FIG. 5 is a graph which shows the distribution, in terms of amount of charge, of the toner particles collected on the intermediary transfer belt while the image forming apparatus is under the developer (toner) expulsion control.
Figure 6:
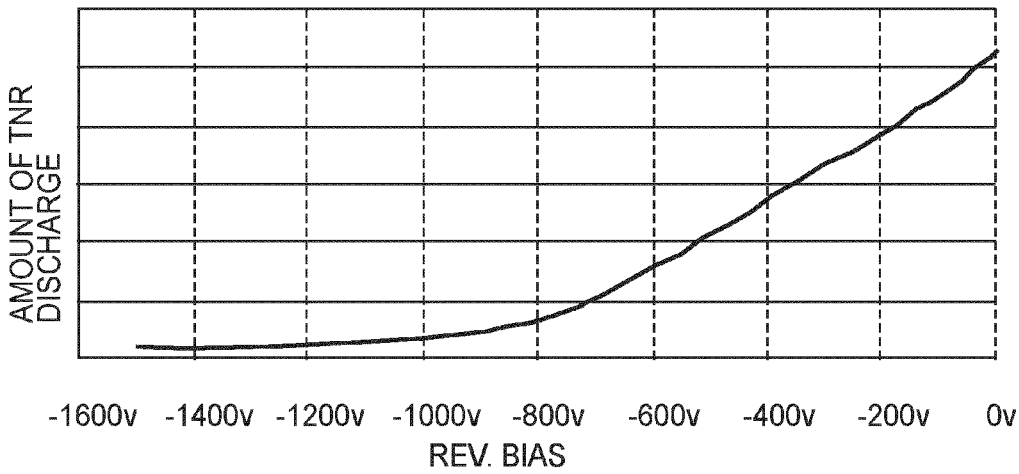
FIG. 6 is a graph which shows the relationship between the amount of toner transferred onto the intermediary transfer belt, and the value of the reverse bias applied, when the image forming apparatus is under the developer (toner) expulsion control.

FIG. 4 is a graph which shows the relationship between the voltage applied to the transfer roller and the amount of current flowed by the voltage. FIG. 5 is a graph which shows the relationship between toner particle distribution and the amount of toner particle charge. FIG. 6 is a graph which shows the relationship between the amount of toner transferred onto the intermediary transfer belt, and the value of the reverse bias applied, in toner expulsion control sequence.

Figure 7:
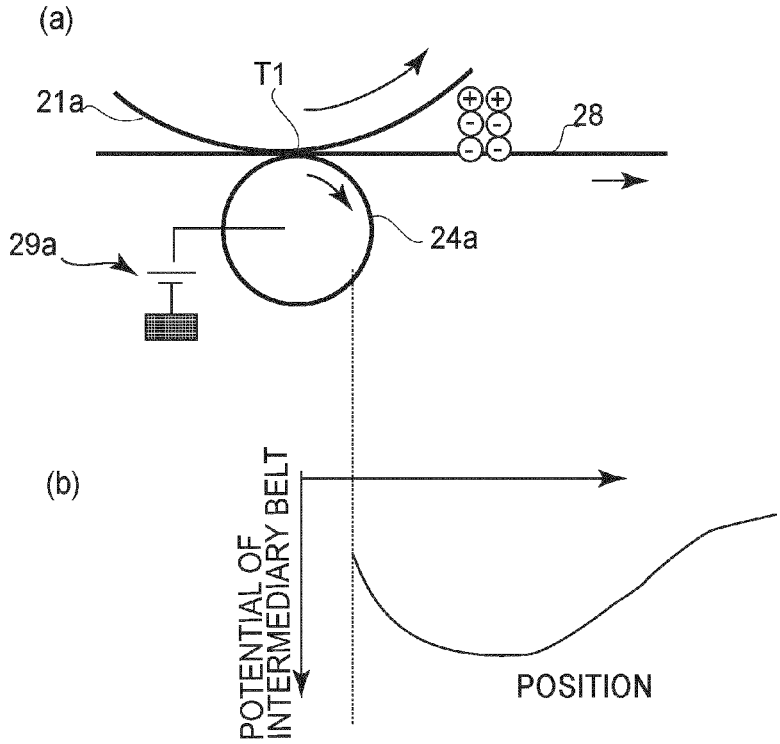
FIG. 7 is a schematic drawing which shows the surface potential distribution of the intermediary transfer belt, in a normal transfer operation.
Figure 8:
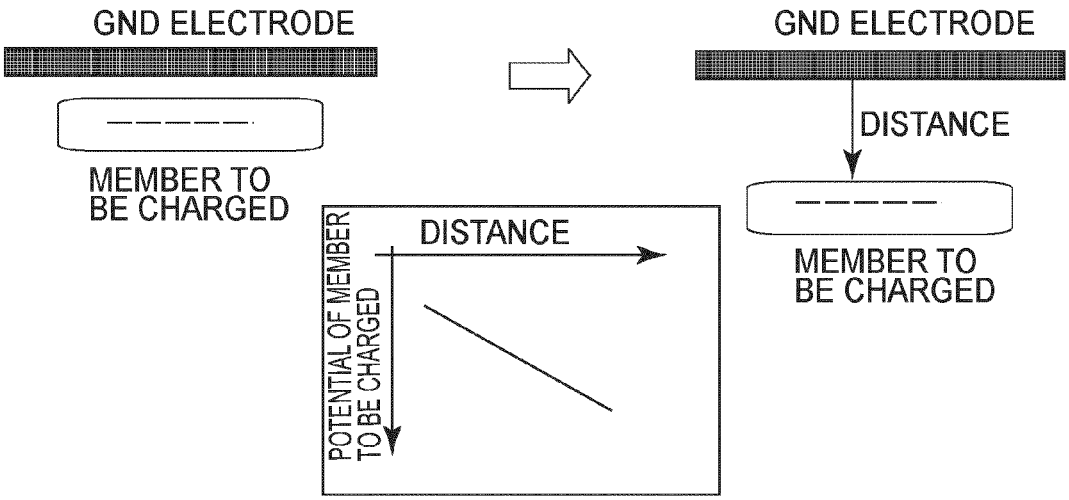
FIG. 8 is a schematic drawing for describing the reason why the surface potential level of the intermediary transfer belt rises on the downstream side of the transferring portion.
Figure 9:
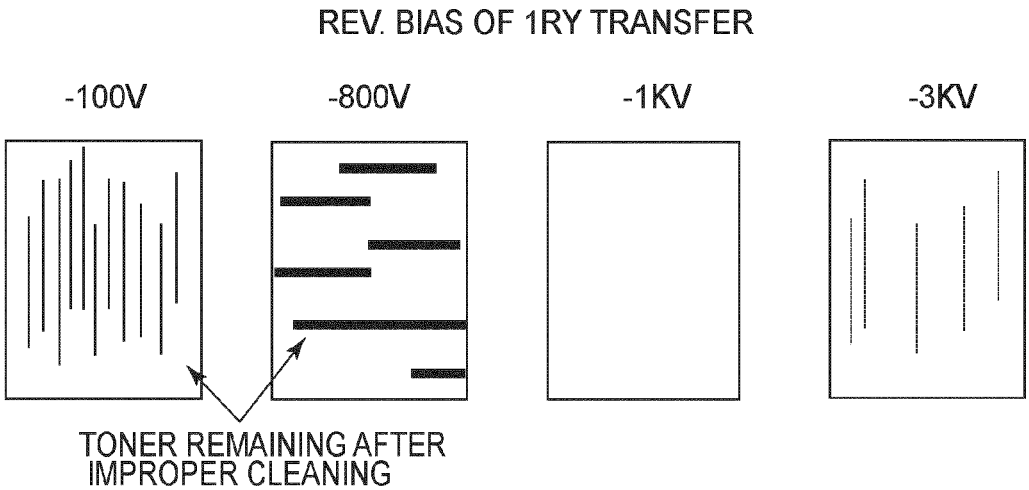
FIG. 9 is a schematic drawing of the copies which were formed immediately after the end of the developer (toner) expulsion control sequence, and which suffer from the defects attributable to unsatisfactory cleaning.

FIG. 7 is a schematic drawing which shows the distribution of the toner charge, in terms of potential level, on the intermediary transfer belt, in a normal transfer operation. FIG. 8 is a schematic drawing which shows the reason why the surface potential level of the intermediary transfer belt rises on the immediately downstream side of the transferring portion. FIG. 9 is a schematic drawing of the copies which were formed immediately after the end of the toner expulsion control sequence, and which suffer from the defects attributable to unsatisfactory cleaning of the intermediary transfer belt.

Next, referring to FIG. 1, the results of the studies made regarding the reverse bias voltage in the toner expulsion control sequence will be described. FIG. 4 shows the relationship between the voltage applied to the transfer roller 24*a* when the photosensitive drum 21*a* is in the fully charged state, and the amount of current flowed toward the photosensitive drum 21*a* by the voltage. The horizontal axis represents the amount of the voltage applied to the transfer roller 24*a*, and the vertical axis represents the amount of electric current, more specifically, the amount of the electric current which flowed in the positive direction (toner transfer direction), that is, toward the photosensitive drum 21*a*.

In this embodiment, in the toner expulsion control sequence, toner is transferred onto the photosensitive drum 21*a* by the amount proportional to the development contrast. The surface potential of the photosensitive drum 21*a* across the area with the toner image is roughly −350 V.

As for the electric current which flows toward the photosensitive drum 21*a*, no current flowed in the negative direction until the transfer voltage was increased in magnitude close to −500 V, as shown in FIG. 4. However, as the transfer voltage was increased in magnitude beyond −500 V, the current began to gradually flow, and then, as the transfer voltage was increased in magnitude beyond −800 V, the current suddenly increased, as indicated by the curved line in FIG. 4. This phenomenon occurred for the following reason: as the voltage applied to the transfer roller 24*a* was increased in magnitude past −500 V, electrical discharge began on the immediate downstream side of the nip of the transfer area T1, and then, as the transfer voltage was increased in magnitude past −800 V, the amount of the discharge current which flowed through the transfer area T1 suddenly increased. In the present invention, the value of the voltage, which corresponds to the point of the curved line in the graph, which shows the relationship between the voltage and current in the transfer area T1, at which the curved line drastically change in curvature, is defined as the discharge start voltage, which in this case is −800 V.

FIG. 5 shows the distribution, in terms of the amount of electrical charge, of the toner particles which were transferred onto the intermediary transfer belt 28 in an experiment in which the reverse bias voltage was varied in magnitude in the toner expulsion control sequence. In the drawing, the horizontal axis represents the amount (amount (μC/g) of triboelectric charge: value obtained by dividing amount of toner charge by amount of toner), and the vertical axis represents the number of toner particles, the amount of electrical charge of which is shown by the horizontal axis, being the electrical charge which the toner particles in a throwaway toner image have in the toner expulsion control sequence. Incidentally, the amount of toner charge was measured by an ESPART (or E-SPART) analyzer (product of Hosokawa Micron Co., Ltd.). The distribution of toner particles in terms of the amount of electrical charge was obtained by calculation, from the Q/d obtained by the ESPART analyzer, d (toner diameter), and the true relative weight of the toner.

Referring to FIG. 5, when the applied voltage was −100 V, which was lower than the discharge start voltage, the distribution curve of the toner charge peaked near where the toner charge was zero. In comparison, when the applied voltage was −1 kV and −3 kV, the distribution of the toner particles in terms of electrical charge deviated toward positive side. The cause for this phenomenon is as follows:

When −100 V was applied, no current flowed between the photosensitive drum 21*a* and transfer roller 24*a*, as shown in FIG. 4. However, the surface potential level of the photosensitive drum 21*a* was −350 V, and the surface potential level of the intermediary transfer belt 28 was −100 V. That is, the intermediary transfer belt 28 was higher in surface potential level. Assuming that the movement of toner particles is controlled by the transfer electric field, the negatively charged toner particles are to transfer from the photosensitive drum 21*a* onto the surface of the intermediary transfer belt 28, and the current which goes with this movement is to be measured.

Referring to FIG. 6, in the toner expulsion control sequence, the amount of the toner in the throwaway toner image transferred onto the intermediary transfer belt 28 was measured, with the reverse bias set at various values. As is evident from FIG. 6, even when −100 V was applied, a certain amount of toner transferred onto the surface of the intermediary transfer belt 28. That is, when the reverse bias was set to −100 V in the toner expulsion control sequence, toner particles which were small in the amount of charge, that is, the toner particles which were weak in the electrostatic force which keeps them adhered to the photosensitive drum 21*a*, were mostly transferred onto the intermediary transfer belt 28, as shown in FIG. 5.

When −1 kV and −3 kV, which are the same in polarity as the discharge start voltage (−800 V), but, are greater in absolute value than the discharge start voltage, were applied, the intermediary transfer belt 28 was lower in surface potential level than the photosensitive drum 21*a*. Therefore, the negatively charge toner particles remained on the photosensitive drum 21*a*, and the reversely charged toner particles in the throwaway toner image transferred onto the intermediary transfer belt 28, with the current flowing toward the intermediary transfer belt 28, as shown in FIG. 4. As for the toner particles which were not affected by electrical charge, more specifically, the toner particles which were small in the amount of positive or negative charge, they transferred onto the intermediary transfer belt 28, and were positively charged, while being accompanied by electrical discharge, as shown in FIG. 5.

Referring to FIG. 7(*a*), on the immediately downstream side (so-called "separation area"), the surface of the intermediary transfer belt 28 gradually increases in surface potential in proportion to the distance from the photosensitive drum 21*a*. This phenomenon occurred for the following reason. That is, as described above, the intermediary transfer belt 28 is usually $1\times10^{6}$-$10^{9}$ Ωcm in volume resistivity, and 70-500 μm in thickness. Referring to FIG. 7(*b*), when the intermediary transfer belt 28, the volume resistivity of which was in the mid range, was used, and the transfer voltage, which was opposite in polarity to normally charged toner, was applied to the transfer roller 24*a*, the potential level of a given point of the intermediary transfer belt 28 initially increased in the negative direction immediately after the given point was moved through the transfer area T1, and then, the potential of the given point gradually decayed as the distance between the given point and the transfer area T1 increased.

Also referring to FIG. 7(*a*), the amount of negative charge which a given point of the intermediary transfer belt 28 has immediately after it was moved through the transfer area T1, is not equal to the amount of positive charge which the given point has immediately after it was moved through the transfer area T1. That is, on the immediately downstream side of the transfer area T1, the given point of the intermediary transfer belt 28 has an excessive amount of negative charge (which hereafter may be referred to as excess charge), and therefore, the given point of the intermediary transfer belt 28 is apparently charged to the negative polarity. However, the given point having this excess charge is moved away from the transfer roller 24*a* by the circular movement of the intermediary transfer belt 28, causing the potential of the given point to increase in the negative direction.

This phenomenon compares to the following phenomenon: Referring to FIG. 8, as a charged object is moved away from a ground electrode, the potential level of the charged object increases in the negative direction. That is, as the distance between the charged object and ground electrode increases, the body of air between the charged object and ground electrode, which functions like a condenser, reduces in capacity. Therefore, the difference in potential level (potential level of charged object) relative to the referential potential level increases. This is the reason why the intermediary transfer belt 28 increases in surface potential level on the downstream side of the transfer area T1, as shown in FIG. 7(*b*).

As the surface potential level of the given point of the intermediary transfer belt 28 increases to a certain value, electrical discharge starts between the given point of the intermediary transfer belt 28 and the photosensitive drum 21*a*. As this electrical discharge occurs, the positive charge which is induced on the peripheral surface of the photosensitive drum 21*a* jumps into the toner particles on the peripheral surface of the intermediary transfer belt 28. As a result, the negative charged toner particles on the intermediary transfer belt 28, which are rather small in the amount of negative charge, are reversed in polarity; they become positively charged. Further, the toner particles on the intermediary transfer belt 28, which are positively charged, but, are insufficient in the amount of positive charge, are supplied with additional positive charge, increasing thereby in the amount of positive charge.

Thus, increasing in value the reverse bias voltage causes the peak of the distribution curve of toner particles in terms of the amount of charge, to change so that more toner particles have positive charge, as shown in FIG. 5. Further, it also causes some of the toner particles having virtually no electrical charge, to receive electrical charge and become positively charged, reducing thereby the amount of the toner having virtually no electrical charge.

When the reverse bias was close to the discharge start voltage (−800 V), discharge did not occur uniformly across the intermediary transfer belt 28; the toner particles on some areas of the intermediary transfer belt 28 were positively and sufficiently charged, whereas the toner particles on the other areas were insufficiently charged. In other words, the surface of the intermediary transfer belt 28 turned into a patchwork of areas having sufficiently positively charged toner particles, and areas having insufficiently positively charged toner particles. Therefore, the areas of the intermediary transfer medium 28 which were subjected to an insufficient amount of electrical discharge were unsatisfactorily cleaned. It is possible that this phenomenon occurred because when the reverse bias voltage was close to the discharge start voltage (−800 V), the distance from the downstream edge of the transfer area T1 to the point at which electrical discharge starts between the intermediary transfer belt 28 and transfer roller 24*a* was longer, and therefore, the discharge cycle was longer.

Regarding the above-mentioned nonuniformity in electrical discharge, it became evident that when the reverse bias voltage was higher by roughly 200 V than the discharge start voltage, the discharge cycle was short enough for the entirety of the toner particles on the intermediary transfer belt 28 to be positively charged to a sufficient level, turning into those which could be easily removed.

However, when the reverse bias voltage was as high as −3,000 V, the toner particles having been transferred onto the intermediary transfer belt 28 in the toner expulsion control sequence were negatively charged to an excessive level, excessively strengthening the mirror force between the toner particles and the surface of the intermediary transfer belt 28. Thus, it became difficult to clean the intermediary transfer belt 28 by the electrically conductive fur brush 121 of the cleaning apparatus 12, which resulted in the unsatisfactory cleaning of the intermediary transfer belt 28. Thus, it became evident that the reverse bias voltage is desired to be no higher than the sum of the discharge start voltage (−800 V) between the photosensitive drum 21*a* and intermediary transfer belt 28, and −2,000 V.

The image forming apparatus 100 was tested for its performance in terms of the cleaning of its intermediary transfer belt, with the reverse bias voltage, which was to be applied in the toner expulsion control sequence, set to −100 V (Example 1 of conventional apparatus), −800 V (Comparative Example 1), −1 kV (Embodiment 1), and −3 kV (Comparative Example 2), based on the results of the above described experiment, and also, with the image ration set to 5%, using ordinary recording paper. The results are given in Table 1.

TABLE 1

| | Opposite bias | Discharging toner Cleaning property |
|---|---|---|
| Prior art 1 | −100 V | N |
| Comp. Ex. 1 | −800 V | F |
| Emb. 1 | −1 Kv | G |
| Comp. Ex. 2 | −3 Kv | F |

FIG. 9 schematically shows the four first copies which were made after the toner transferred onto the intermediary transfer belt 28, was removed by the cleaning apparatus 12, in the toner expulsion control sequence in which the reverse bias voltage were set to the above-mentioned values, respectively. As shown in FIG. 9, when the reverse bias voltage was −100 V, which was lower than the discharge start voltage (−800 V), the entirety of the intermediary transfer belt 28 failed to be satisfactorily cleaned. When the reverse bias voltage was close to −800 V, which is the discharge start voltage, some portions of the intermediary transfer belt 28 were unsatisfactorily cleaned. When the reverse bias voltage was −1 kV, which is 200 V higher than the discharge start voltage (−800 V), cleaning failure did not occur. When the reverse bias voltage was −3 kV, which was 2,300 V higher than the discharge start voltage (−800 V), it was difficult to remove the toner particles which was negatively charged to an excessively level. Therefore, copies which suffered from faint defects attributable to unsatisfactory cleaning were produced.

Thus, in this embodiment, or the first embodiment, of the present invention, the reverse bias voltage, which was to be applied in the toner expulsion control sequence, which is carried out during the paper intervals, was set to −1 kV, based on FIGS. 5 and 6, and the results of the experiments given in Table 1.

As described above, setting the reverse bias voltage to a level higher than the discharge start voltage (−800 V) when the toner expulsion control sequence was carried out during the paper intervals in a normal image forming operation, prevents the intermediary transfer belt 28 from being unsatisfactorily cleaned immediately after the end of the control sequence. Therefore, it is unnecessary to idly circulate the intermediary transfer belt 28 to clean it, as opposed to the necessity to idly rotate the intermediary transfer belt 28 to remove the toner image which remained on the intermediary transfer belt 28 because of paper jam or the like. In other words, it does not add to the time necessary for restoring the image forming apparatus in performance.

Further, normally, the frequency with which the cumulative values of the above described difference for all of the four primary colors simultaneously reach 100% is rare. Therefore, as soon as the cumulative value of the difference of even one among the yellow, magenta, cyan, and black color component reaches 100%, the toner expulsion control sequence is activated, in which a solid image, the length of which in terms of the rotational direction of the photosensitive drum 21*a* is equivalent to the cumulative value of the difference for each color component, is formed as a throwaway toner image. Therefore, the toner expulsion control sequence in this embodiment is shorter, and smaller in the number of times the paper interval needs to be extended for toner expulsion control sequence, being therefore shorter in downtime, than a toner expulsion control sequence in accordance with the prior art, in which a toner expulsion control sequence is carried out for each color component.

In the toner expulsion control sequence in this embodiment, the toner image formed on the image bearing member (21*a*) moves through the primary transfer area T1 while voltage, the polarity of which is the same as the polarity of the normally charged toner, and the absolute value of which is greater than the absolute value of the discharge start voltage, is applied to the primary transferring member (24*a*). After the toner image moved through the primary transfer area T1, it is recovered by the image bearing member cleaning means (25*a*). The toner particles having adhered to the intermediary transfer belt (28) in the primary transfer area T1 are removed by the intermediary transfer belt cleaning means (12). Further, there is the following relationship between the discharge start voltage (V0), and the voltage (V1) applied to above-mentioned primary transferring member (24*a*) in the toner expulsion control sequence: $|V0|+200\ V<|V1|\leqq|V0|+2{,}000$.

In the above, this embodiment was described with reference to the image forming apparatus 100 which uses negatively chargeable toner, and applies the reverse bias voltage, which is negative in polarity, to the transfer roller 24*a*. However, the present invention is also applicable to an image forming apparatus which uses positively chargeable toner (normally chargeable toner) to form an image, and applies reverse bias voltage, which is positive in polarity, to the transfer roller when forming a throwaway toner, just as effectively as it is to the image forming apparatus 100 in this embodiment. In the case of an image forming apparatus which uses positively chargeable toner, the intermediary transfer belt can be cleaned, just as quickly as in the case of the image forming apparatus 100, by setting the reverse bias voltage so that it is the same in polarity (positive polarity) as the toner, and is greater in absolute value than the discharge start voltage.

Embodiment 2

Figure 10:
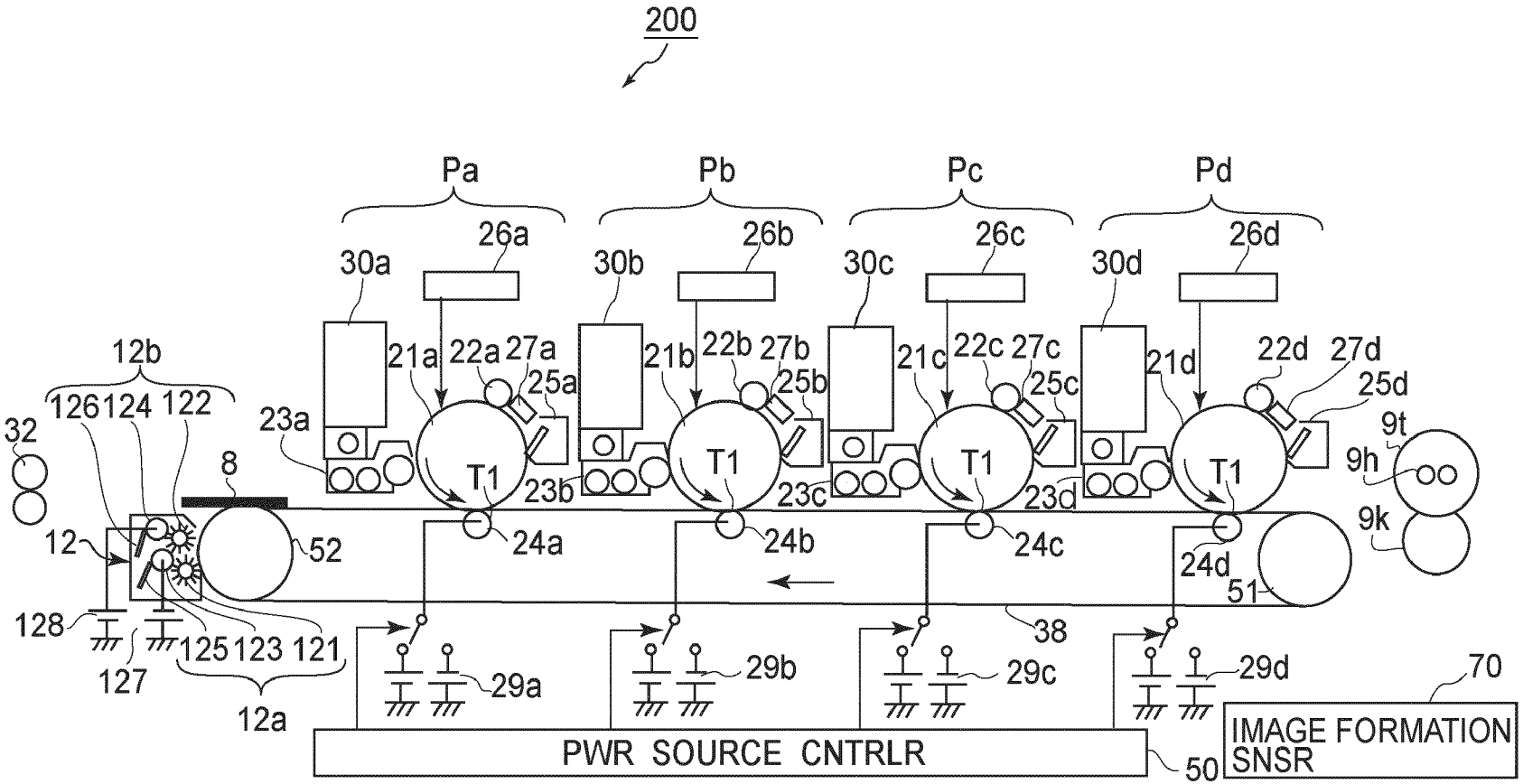
FIG. 10 is a schematic sectional view of the image forming apparatus in the second embodiment of the present invention.

FIG. 10 is a schematic sectional view of the image forming apparatus in the second embodiment of the present invention, and shows the structure of the apparatus. The image forming apparatus 200 in the second embodiment is the same in structure as the image forming apparatus 100 in the first embodiment, except that the image forming apparatus 200 is provided with a recording medium conveying belt 38 instead of the intermediary transfer belt 28. That is, the image forming portions Pa, Pb, Pc, and Pd, cleaning apparatus 12, fixing apparatus 9, etc., of the image forming apparatus 200 are the same as those of the image forming apparatus 100. Thus, the structural components of the image forming apparatus 200, which are shown in FIG. 10, and correspond to those of the image forming apparatus 100, which are shown in FIG. 1, are given the same referential symbols as those given to the corresponding components of the image forming apparatus 100, in order not to repeat the same description.

Not only is the present invention applicable to an image forming apparatus which employs an intermediary transfer belt, but also, the image forming apparatus 200, shown in FIG. 10, which employs a recording medium conveying belt 38. The control executed by the image forming apparatus 200 in this embodiment to prevent a throwaway toner image from being transferred onto the recording medium conveying belt 38 is the same as that executed by the image forming apparatus 100 in the first embodiment. That is, reverse bias voltage is used to prevent a throwaway toner image from being transferred onto the recording medium conveying belt 38 (recording medium conveying member). Incidentally, in this embodiment, while the toner expulsion control sequence is executed, recording medium is not delivered to the recording medium conveying belt 38. That is, while the toner expulsion control sequence is executed, there is no recording medium in the transfer area T1. Further, the reverse bias voltage is set to −1,000 V to prevent the cleaning apparatus 12 from unsatisfactorily clean the recording medium conveying belt 38. In order to prevent developer from deteriorating, the toner in the developing apparatuses 23*a*, 23*b*, 23*c*, and 23*d* are expelled onto the portions of the corresponding photosensitive drums 21*a*, 21*b*, 21*c*, and 21*d*, respectively, which correspond to the paper intervals. Therefore, it is possible to minimize the length of the downtime, without subjecting the cleaning apparatus 12, with which the recording medium conveying belt 38 is provided, to an excessive amount of load.

Referring to FIG. 10, as the recording medium 8 is pulled out of an unshown sheet feeder cassette, it is conveyed through a pair of registration rollers 32, and is delivered to the recording medium conveying belt 38, which is an example of a recording medium conveying member. As the recording medium 8 is delivered to the recording medium conveying belt 38, it is electrostatically adhered to the belt 38. The recording medium conveying belt 38 is stretched around a driver roller 51 and a follower roller 52, being thereby suspended by the two rollers. There are four image forming portions Pa, Pb, Pc, and Pd, which are juxtaposed in parallel in the direction in which the recording medium conveying belt 38 moves. The driver roller 51 is rotationally driven by an unshown motor (for example, stepping motor). As the driver roller 51 is rotationally driven, the driving force from the motor is transmitted from the driver roller 51 to the recording medium conveying belt 38.

The peripheral velocity of the photosensitive drums 21*a*, 21*b*, 21*c*, and 21*d* and the surface velocity of the recording medium conveying belt 38 are set so that they are virtually the same in each of the transfer areas T1. The image forming process carried out in the image forming apparatuses Pa, Pb, Pd, and Pd of the image forming apparatus in this embodiment is the same as that in the first embodiment, except for the process carried out in the transfer area T1, and therefore, will not be described here.

Next, the process carried out in the transfer area T1 will be described. The image formation step-transfer step are carried out in each of the image forming portions Pa, Pb, Pc, and Pd. The recording medium 8 borne on the recording medium conveying belt 38 is moved through each transfer area T1 with the same timing as the timing with which monochromatic toner images, different in color, formed on the photosensitive drums 21*a*, 21*b*, 21*c*, and 21*d*, reach the corresponding transfer areas T1, respectively.

While the recording medium 8 is conveyed through the transfer area T1, transfer power sources 29*a*, 29*b*, 29*c*, and 29*d*, which are examples of electric power supplying means, output transfer voltages, which are positive in polarity, to the transfer rollers 24*a*, 24*b*, 24*c*, and 24*d*, respectively, which are examples of transferring means. Thus, a yellow toner image (normal toner image) is first transferred from the photosensitive drum 21*a* onto the recording medium 8, and then, a magenta toner image (normal toner image) is transferred onto the recording medium 8 from the photosensitive drum 21*b*. Then, a cyan toner image (normal toner image) is transferred onto the recording medium 8 from the photosensitive drum 21*c*, and lastly, a black toner image (normal toner image) is transferred onto the recording medium 8 from the photosensitive drum 21*d*. In other words, four monochromatic toner images, different in color, are sequentially and directly transferred in layers onto the recording medium 8. Thereafter, the recording medium 8 is separated from the recording medium conveying belt 38, and is delivered to the fixing apparatus 9. The fixing apparatus 9 fixes the four color toner images to the recording medium 8 by applying heat and pressure. After the fixation, the recording medium 8 is discharged from the image forming apparatus 200, ending the sequence of image formation steps.

The image forming apparatus 200 is provided with a cleaning apparatus 12 (means for cleaning recording medium conveying member) for removing the fog causing toner particles and the like on the recording medium conveying belt 38, which is an example of a recording medium conveying member. The cleaning apparatus 12 is located next to the follower roller 52, with the presence of the recording medium conveying belt 38 between the cleaning apparatus 12 and follower roller 52. Normally, the amount of the toner which reaches the cleaning apparatus 12 is very small, being no greater than the amount of the toner which leaves foggy stains on recording medium (copy). Therefore, the cleaning apparatus 12 in this embodiment is designed to electrostatically clean the recording medium conveying belt 38. More specifically, it is equipped with a pair of electrically conductive fur brushes 121 and 122, which are unlikely to peel the surface layer of the belt 38 as does a cleaning blade.

The electrically conductive fur brush 121, metallic roller 123, and cleaning blade 125 make up the upstream cleaning portion 12*a*, whereas the electrically conductive fur brush 122, metallic roller 124, and cleaning blade 126 make up the downstream cleaning portion 12*b*. The upstream cleaning portion 12*a* removes the positively charged toner particles on the recording medium conveying belt 38, by charging the electrically conductive fur brush 121 to the negative polarity. The downstream cleaning portion 12*b* removes the negatively charged toner particles on the recording medium conveying belt 38, by negatively charging the electrically conductive fur brush 122.

Incidentally, the amount of the toner transferred onto the metallic rollers 123 and 124 from the electrically conductive fur brushes 121 and 122, respectively, is very small. Therefore, the blades 125 and 126 which are kept in contact with the metallic rollers 123 and 124, respectively, may be controlled (reduced) in contact pressure to prevent the surface layer of the recording medium conveying belt 38 from being peeled by the blades.

Also in the case of the image forming apparatus 200, the bias to be applied in the transfer area T1 while the image forming apparatus 200 is controlled to expel developer from the developing apparatus, was set to −1 kV, as it was in the first embodiment. When the developer expulsion control was carried out during the paper intervals of a normal image forming operation, the reverse bias voltage was set to a value which is greater than the value of the discharge start voltage.

With the employment of the above described developer expulsion control, the second embodiment provided the same effects as those provided by the first embodiment. That is, the toner particles, which were in the throwaway toner image, and were transferred onto the recording medium conveying belt 38, by positively charging the toner particles with the application of the reverse bias voltage, were removed from the recording medium conveying belt 38. Therefore, the cleaning apparatus 12, which was rather small in capacity, was sufficient to thoroughly clean the recording medium conveying belt 38. Therefore, it is possible to minimize the problem attributable to the toner particles which transfer from the recording medium conveying belt 38 onto the back side of the recording medium 8 because the recording medium conveying belt 38 is not thoroughly cleaned. Further, the recovery time dedicated to the operation in which the recording medium conveying belt 38 is idly circulated became unnecessary, reducing thereby the length of the time necessary for restoring an image forming apparatus in performance.

When an image forming apparatus is in the developer (toner) expulsion mode, voltage, the polarity of which is the same as that of the normally (negatively) charged toner, and which is greater in absolute value than the discharge start voltage, is continuously applied to a transferring member (24*a*) while a toner image (throwaway toner image) formed on an image bearing member (21*a*) is moved through the transfer area T1. After being moved through the transfer area T1, most of the toner image is recovered by an image bearing member cleaning means (25*a*), and the small amount of toner, which adhered to the recording medium conveying belt (38) in the transfer area T1 is removed by the recording medium conveying member cleaning means. There is the following relationship between the discharge start voltage (V0), and the voltage (V1) applied to above-mentioned primary transferring member (24*a*) in the abovementioned mode: $|V1|+200 V<|V1|\leqq|V0|+2{,}000$.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 028595/2007 filed Feb. 7, 2007, which is hereby incorporated by reference.

What is claimed is:

1. An image forming apparatus comprising:

an image bearing member;

toner image forming means for forming a toner image, which is formed on a recording material, and for forming a toner pattern, which is not formed on a recording material;

an intermediary transfer member, contactable to said image bearing member, for forming a primary transfer portion for primary transfer of the toner image from said image bearing member;

a primary transfer member for being supplied with a transfer voltage for primary transfer of the toner image from said image bearing member onto said intermediary transfer member;

a voltage source for supplying, to said primary transfer member, a transfer voltage and a voltage of a polarity opposite to the transfer voltage;

image bearing member cleaning means for removing toner from said image bearing member;

secondary transferring means for secondary transfer of the toner image from said intermediary transfer member onto a recording material;

intermediary transfer member cleaning means for electrostatically removing toner from said intermediary transfer member; and voltage source control means for controlling said voltage source so as to apply, to said primary transfer member, a voltage having an absolute value larger than a discharge starting threshold voltage and having the polarity opposite to the transfer voltage, when the toner pattern passes through said primary transfer portion.

2. An apparatus according to claim 1, wherein the discharge starting threshold voltage V0 and the transfer voltage V1 applied to said primary transfer member satisfy the following relationship:

$$|V0|+200V<|V1|\leqq|V0|+2000V.$$

3. An apparatus according to claim 1, wherein said image bearing member cleaning means includes a blade contacted to said image bearing member.

4. An apparatus according to claim 1, wherein said intermediary transfer member cleaning means includes a brush contacted to said intermediary transfer member.

5. An image forming apparatus comprising:

an image bearing member bearing a toner image and a toner pattern;

toner image forming means for forming the toner image, which is formed on a recording material, and for forming the toner pattern, which is not formed on a recording material;

a recording material carrying member for contacting to said image bearing member to form a transfer portion and for carrying a recording material;

a transfer member for being supplied with a transfer voltage for transferring, in said transfer portion, the toner image from said image bearing member onto a recording material carried on said recording material carrying member;

a voltage source for applying, to said transfer member, a transfer voltage and a voltage having a polarity opposite to the transfer voltage;

image bearing member cleaning means for removing toner from said image bearing member;

recording material carrying member cleaning means for electrostatically removing toner from said recording material carrying member; and voltage source control means for controlling said voltage source so as to apply, to said transfer member, a voltage having an absolute value larger than a discharge starting threshold voltage and having the polarity opposite to the transfer voltage, when the toner pattern passes through said transfer portion.

6. An apparatus according to claim 5, wherein the discharge starting threshold voltage V0 and the transfer voltage V1 applied to said transfer member satisfy the following relationship:

$$|V0|+200V<|V1|\leqq|V0|+2000V.$$

7. An apparatus according to claim 5, wherein said image bearing member cleaning means includes a blade contacted to said image bearing member.

8. An apparatus according to claim 5, wherein said recording material carrying member cleaning means includes a brush contacted to said recording material carrying member.

9. An apparatus according to claim 1, wherein a number of pixels of the toner image formed on said image bearing member is integrated, and when an integrated value satisfies a predetermined condition, the toner pattern is formed.

10. An apparatus according to claim 1, further comprising:

a second image bearing member;

second toner image forming means for forming a toner image, which is formed on a recording material, and for forming a toner pattern, which is not formed on a recording material; and a second primary transfer member for being supplied with a transfer voltage for primary transfer of the toner image from said second image bearing member onto said intermediary transfer member, wherein numbers of pixels of the toner images formed on said respective image bearing members are integrated, and when at least one integrated value satisfies a predetermined condition, the toner patterns are formed on said image bearing member and said second image bearing member.

11. An apparatus according to claim 5, wherein a number of pixels of the toner image formed on said image bearing member is integrated, and when an integrated value satisfies a predetermined condition, the toner pattern is formed.

12. An apparatus according to claim 5, further comprising:

a second image bearing member;

a second toner image forming means for forming a toner image, which is formed on a recording material and for forming a toner pattern, which is not formed on a recording material; and a second transfer member for being supplied with a transfer voltage for transferring, in said transfer portion, the toner image from said image bearing member onto a recording material carried on said recording material carrying member.

* * * * *